US008601719B2

(12) United States Patent
Lee et al.

(10) Patent No.: US 8,601,719 B2
(45) Date of Patent: Dec. 10, 2013

(54) DUCT FOR DRYER

(75) Inventors: Ju Dong Lee, Bupyeong-gu (KR); Chang Hoo Kim, Gyeyang-gu (KR)

(73) Assignee: Daewoo Electronics Corporation, Seoul (KR)

( * ) Notice: Subject to any disclaimer, the term of this patent is extended or adjusted under 35 U.S.C. 154(b) by 645 days.

(21) Appl. No.: 12/343,525

(22) Filed: Dec. 24, 2008

(65) Prior Publication Data

US 2009/0165325 A1 Jul. 2, 2009

(30) Foreign Application Priority Data

Dec. 27, 2007 (KR) ..... 10-2007-0139519
Dec. 27, 2007 (KR) ..... 10-2007-0139520

(51) Int. Cl.
*F26B 11/02* (2006.01)
*F26B 21/06* (2006.01)
*F24F 13/20* (2006.01)

(52) U.S. Cl.
USPC ..... 34/602; 34/595; 34/603; 454/367

(58) Field of Classification Search
USPC ..... 34/138, 595, 596, 602, 603, 604, 605, 34/607, 608, 609, 610, 139, 140, 235; 454/261, 277, 279, 281, 282, 367
See application file for complete search history.

(56) References Cited

U.S. PATENT DOCUMENTS

| | | | | |
|---|---|---|---|---|
| 2,798,306 | A * | 7/1957 | Reiter | 34/609 |
| 2,970,464 | A * | 2/1961 | Toma | 68/19.1 |
| 3,155,462 | A * | 11/1964 | Erickson et al. | 34/82 |
| 3,398,465 | A * | 8/1968 | Miller et al. | 34/599 |
| 3,670,143 | A * | 6/1972 | Zenz | 392/379 |
| 3,959,891 | A * | 6/1976 | Burkall | 34/82 |
| 5,094,015 | A * | 3/1992 | Griffith | 34/235 |
| 6,082,022 | A * | 7/2000 | St. Louis | 34/602 |
| 6,223,452 | B1 * | 5/2001 | Hamand | 34/267 |
| 2006/0085996 | A1 * | 4/2006 | Hwang | 34/82 |
| 2007/0251114 | A1 * | 11/2007 | Kim | 34/82 |

* cited by examiner

*Primary Examiner* — Kenneth Rinehart
*Assistant Examiner* — John McCormack
(74) *Attorney, Agent, or Firm* — Murabito Hao & Barnes LLP; Andrew D. Fortney

(57) ABSTRACT

A duct for a dryer includes an intake duct provided with a discharge part formed with a discharge hole for discharging air therethrough and a coupling hole formed around the discharge part; and a contact prevention part seated in the coupling hole and spaced apart from the discharge part.

4 Claims, 6 Drawing Sheets

DUCT FOR DRYER

CROSS-REFERENCE TO RELATED APPLICATIONS

The present application claims priority to Korean patent application number 10-2007-0139519, filed on Dec. 27, 2007 and 10-2007-0139520, filed on Dec. 27, 2007, which are incorporated by reference in its entirety.

BACKGROUND OF THE INVENTION

The present invention relates to a duct for a dryer, and more particularly, to a duct for a dryer which prevents laundries to be dried from being brought into contact with an exhaust hole or an exhaust part through which high temperature air is discharged, thereby restricting damage of the laundries.

In general, a dryer is an apparatus in which heated air is blown into an inside of a drum to dry laundries. FIG. 1 is a schematic structural view showing a conventional dryer and FIG. 2 is a perspective view showing an intake duct of the conventional dryer.

Referring to FIG. 1, the conventional dryer 10 includes a case 2 which forms an external appearance of the dryer and provided with an opening formed in front thereof and through which laundries to be dried are put into and drawn out of the dryer, a drum 12 which is rotatably mounted in the case 2 to accommodate the laundries to be dried and has opened front and rear portions for allowing air to pass therethrough, a heater 18 which heats the air sucked into the case 2, an intake duct 20 which guides the heated air passed through the heater 18 to the rear of the drum 12 and an exhaust unit 15 which exhausts the air polluted by drying the laundries to the outside of the case 2.

By operating the dryer after putting the laundries to be dried into the inside of the drum 12, the motor (not shown) is driven to rotate the drum 12 and the blower fan (not shown) and the heater 18 is also operated.

With the rotation of the drum 12, the laundries to be dried in the drum 12 are lifted up and dropped by a lifter (not shown). External air is sucked in an inside of the heater 18 by rotation of the blower fan, heated to air with high temperature and low humidity and then supplied to the inside of the drum 12 through the intake duct 20.

The air with high temperature and low humidity supplied to the inside of the drum 12 is brought into contact with the laundries to dry the laundries. As the dry process goes on, the supplied air is gradually changed to air with low temperature and high humidity, moved to the front of the drum 12 and then discharged to the outside of the dryer 10 through the exhaust unit 15.

Referring to FIG. 2, the intake duct 20 is provided with the heater 18 for heating the air at a lower part thereof and a discharge part 21 for discharging the air to the drum 12 (refer to FIG. 1) at an upper part thereof.

The discharge part 21 is made of a metal material resistant to the high temperature air and provided with a plurality of discharge holes 22.

In the conventional dryer, since the high temperature air is discharged through the intake duct, the discharge part is heated by a long term operation of the dryer.

When the discharge part is heated, there may occur a problem that the laundries to be dried may be brought into contact with the heated discharge part and thus damaged during the laundries are dropped by the rotation of the drum.

In addition, there is a problem that the discharge part may be damaged when naps separated from the laundries may be brought into contact with the discharge part and thus carbonized. Therefore, it is required to improve the problems.

SUMMARY OF THE INVENTION

Embodiments of the present invention are directed to a duct for a dryer which prevents the laundries to be dried from being brought into contact with the heated discharge part to prevent damage of the laundries and discharge part.

In one embodiment, a duct for a dryer includes an intake duct provided with a discharge part formed with a discharge hole for discharging air therethrough and a coupling hole formed around the discharge part; and a contact prevention part seated in the coupling hole and spaced apart from the discharge part.

Preferably, the contact prevention part includes a heat resistant plastic material.

Preferably, the contact prevention part includes a prevention plate formed with a through hole; and a coupling projection extended in an outward radial direction of the prevention plate to be inserted in the coupling hole;

More preferably, the through hole is formed at a position corresponding to the position of the discharge hole.

More preferably, the contact prevention part includes a heat resistant plastic material.

In another embodiment, a duct for a dryer includes an intake duct for supplying air to a drum, wherein the intake duct is provided with a discharge part in which a front side thereof in a rotation direction of the drum is further projected than the rear side thereof in the rotation direction of the drum to form an inclined shape.

In further another embodiment, a duct for a dryer includes an intake duct for supplying air to a drum, wherein the intake duct is provided with a discharge part formed with a discharge hole for discharging air therethrough and a prevention rib projected from the discharge part.

Preferably, the discharge part is formed so that a front side thereof in a rotation direction of the drum is further projected than the rear side thereof in the rotation direction of the drum to form an inclined shape.

Preferably, a plurality of the prevention ribs is disposed apart from each other.

Preferably, the prevention rib is formed with an inclined face at a face opposite to a rotation direction of the drum.

Preferably, the prevention rib is formed integrally with the discharge part.

Preferably, the prevention rib is formed separately from the discharge part.

More preferably, the prevention rib includes a heat resistant plastic material.

In a duct for a dryer according to the present invention, since the contact prevention part prevents the contact between the laundries to be dried and the discharge part, it is possible to inhibit damage of the discharge part and the laundries.

Also, in a duct for a dryer according to the present invention, since the discharge part is inclinedly formed with a predetermined angle with respect to the rotation direction of the drum, it is possible to reduce a contact area between the laundries to be dried and the discharge part and thus inhibit damage of the discharge part and the laundries.

Further, in a duct for a dryer according to the present invention, since the prevention rib of the discharge part prevents the contact between the laundries to be dried and the discharge hole, it is possible to inhibit damage of the discharge part and the laundries.

DESCRIPTION OF SPECIFIC EMBODIMENTS

Hereinafter, an exemplary embodiment of the present invention will be described with reference to accompanying drawings. It should be noted that the drawings are not to precise scale and may be exaggerated in thickness of lines or size of components for the purpose of convenience and clarity only.

Furthermore, terms used herein are defined in consideration of functions in the present invention and can be changed according to the custom or intention of users or operators. Thus, definition of such terms should be determined according to overall disclosures set forth herein.

This present invention relates to a duct for a dryer and the general structure of the dryer will not be described in detail since it has already been described in the Background section.

Figure 1:
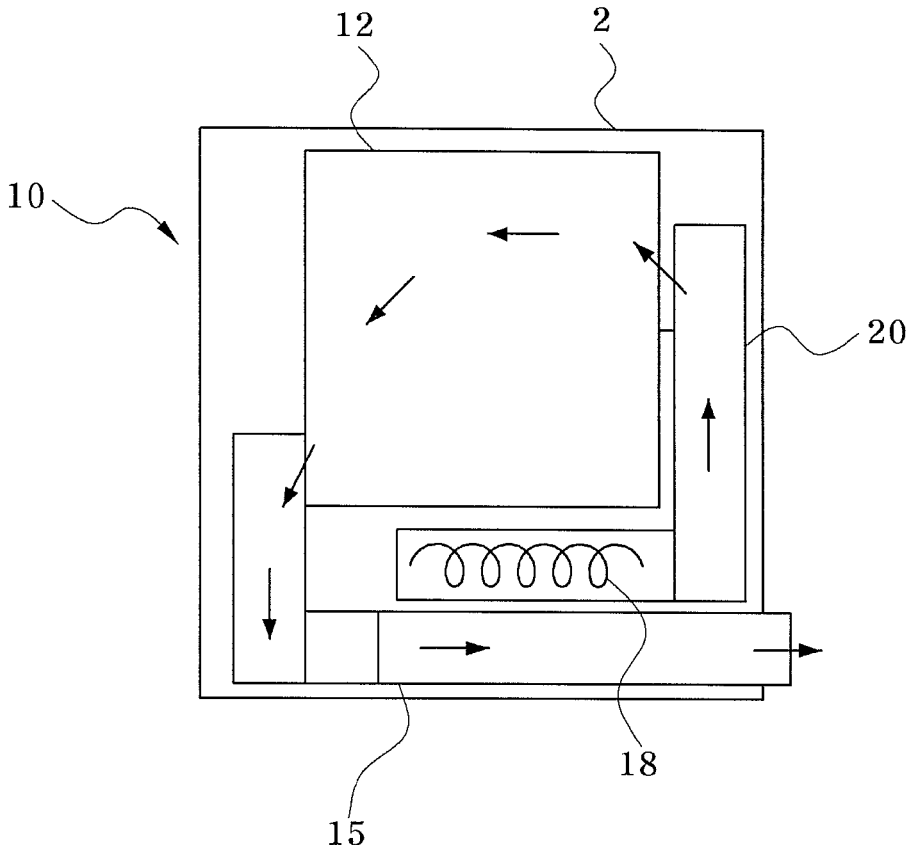
Fig. 1 Prior Art
FIG. 1 is a schematic structural view showing a conventional dryer.
Figure 2:
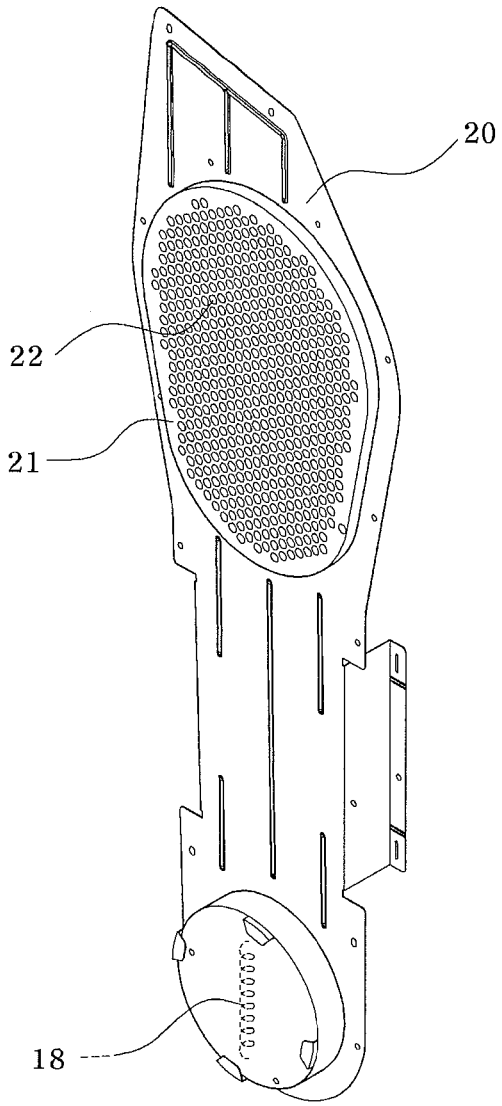
Fig. 2 Prior Art
FIG. 2 is a perspective view showing an intake duct of the conventional dryer.
Figure 3:
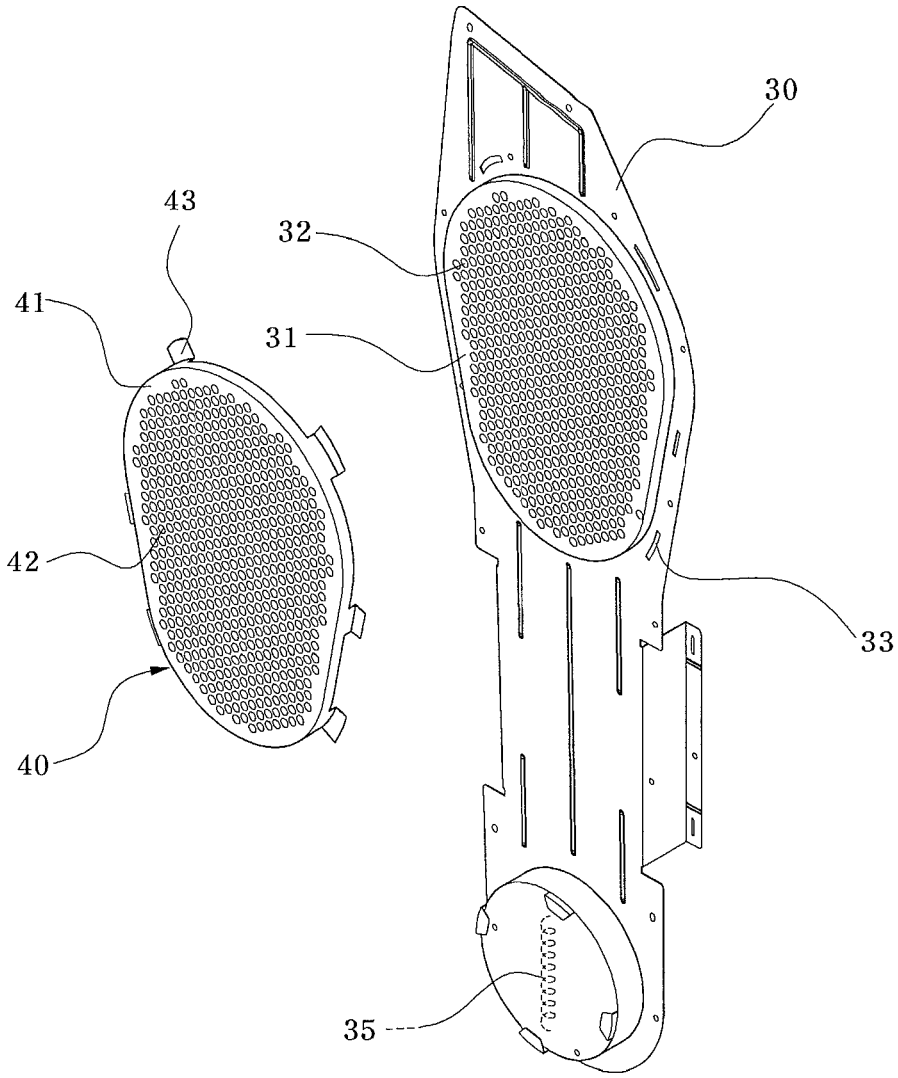
FIG. 3 is an exploded perspective view illustrating an intake duct and a contact prevention part in accordance with an embodiment of the present invention.
Figure 4:
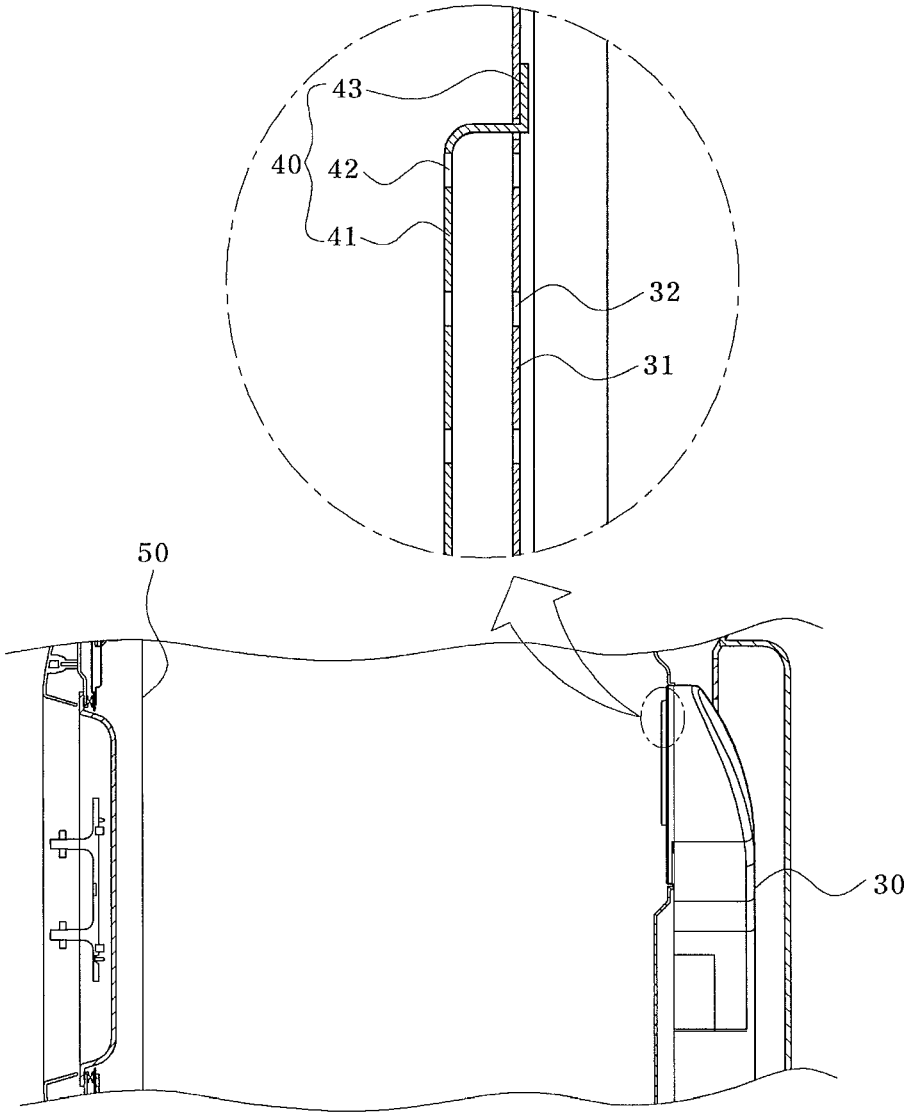
FIG. 4 is an assembled sectional view illustrating the intake duct mounted with the contact prevention part in accordance with an embodiment of the present invention.

FIG. 3 is an exploded perspective view illustrating an intake duct and a contact prevention part in accordance with an embodiment of the present invention and FIG. 4 is an assembled sectional view illustrating the intake duct mounted with the contact prevention part in accordance with an embodiment of the present invention.

Referring to FIGS. 3 and 4, in a dryer, air heated by a heater is supplied to a drum 50 through an intake duct 30 to dry laundries to be dried.

The intake duct 30 is formed with a discharge part 31 and communicated with the drum 50 at one end thereof. The discharge part 31 is made of a metal material so as to resist to high temperature air for a long time.

The discharge part 31 is formed with a plurality of discharge holes 32. The intake duct 30 is formed with coupling holes 33 around the discharge part 31.

To the coupling holes 33, a contact prevention part 40 is coupled, which is a separate part from the intake duct 30. Since the contact prevention part 40 is coupled so as to be spaced apart from a front of the discharge part 31 by a predetermined distance, the contact prevention part 40 prevents the laundries to be dried from being brought in direct contact with the discharge part 31.

The contact prevention part 40 is provided with a prevention plate 41 and coupling projections 43.

The prevention plate 41 is formed with a plurality of through holes 42 and the through holes 42 are formed at positions corresponding to the position of the discharge holes 32 so that the air passed through the discharge holes 32 is smoothly moved to the inside of the drum 50.

The coupling projections 43 are extended from the edge of the prevention plate 41 in an outward radial direction and seatedly inserted in the coupling holes 33, respectively, to mount the contact prevention part 40 to the intake duct 30.

Since the prevention plate 41 is formed so as to be projected from the coupling projections 43 by a predetermined distance, the prevention plate 41 is spaced apart from the discharge part 31.

Meanwhile, the prevention plate 41 is formed so as not to be projected over the inner surface of the supporting panel (not shown) to which the drum 50 is supported and thus does not obstruct the rotation of the laundries to be dried.

While the coupling projection 43 has a hook shape in the present embodiment, the coupling projection 43 is not limited thereto and may have various shapes provided that the coupling projection 43 can be seatedly inserted in the coupling hole 33.

The contact prevention part 40 is includes a heat resistant and flame retardant plastic material which is not deformed by the high temperature air and does not damage the laundries to be dried though brought into contact with the laundries to be dried.

Hereinafter, operation of the duct for a dryer in accordance with an embodiment of the present invention will be described.

The laundries to be dried stored in the inside of the drum 50 is lifted up and then dropped by the rotation of the drum 50 and is dried by the heated air supplied to the drum 50.

The contact prevention part 40 is coupled to the intake duct 30 which guides the high temperature air to the inside of the drum 50 to prevent the laundries to be dried from being brought in direct contact with the discharge part 31 of the intake duct 30 while laundries to be dried are lifted up and dropped.

That is to say, since the contact prevention part 40 prevents the direct contact between the laundries and the discharge part 31, it is possible to inhibit the laundries to be dried from being damaged by the high temperature discharge part 31.

Also, since the naps separated from the laundries are not stuck to the discharge part 31, it is possible to prevent the damage of the discharge part 31.

Figure 5:
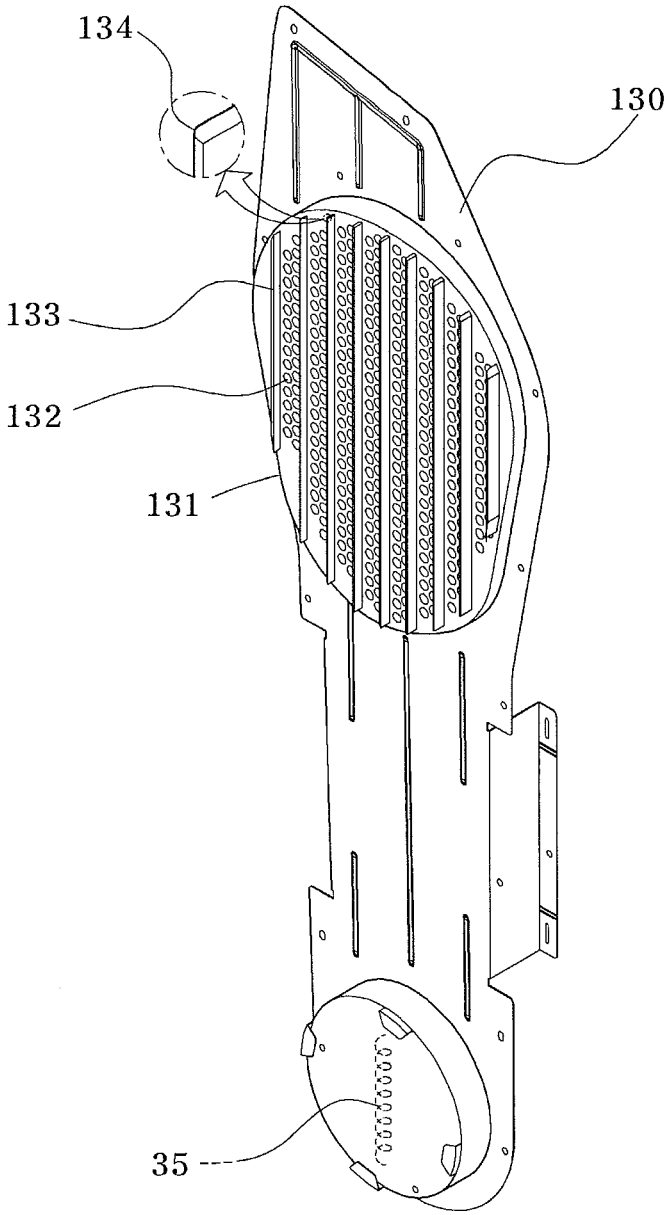
FIG. 5 is a perspective view illustrating an intake duct in accordance with another embodiment of the present invention.
Figure 6:
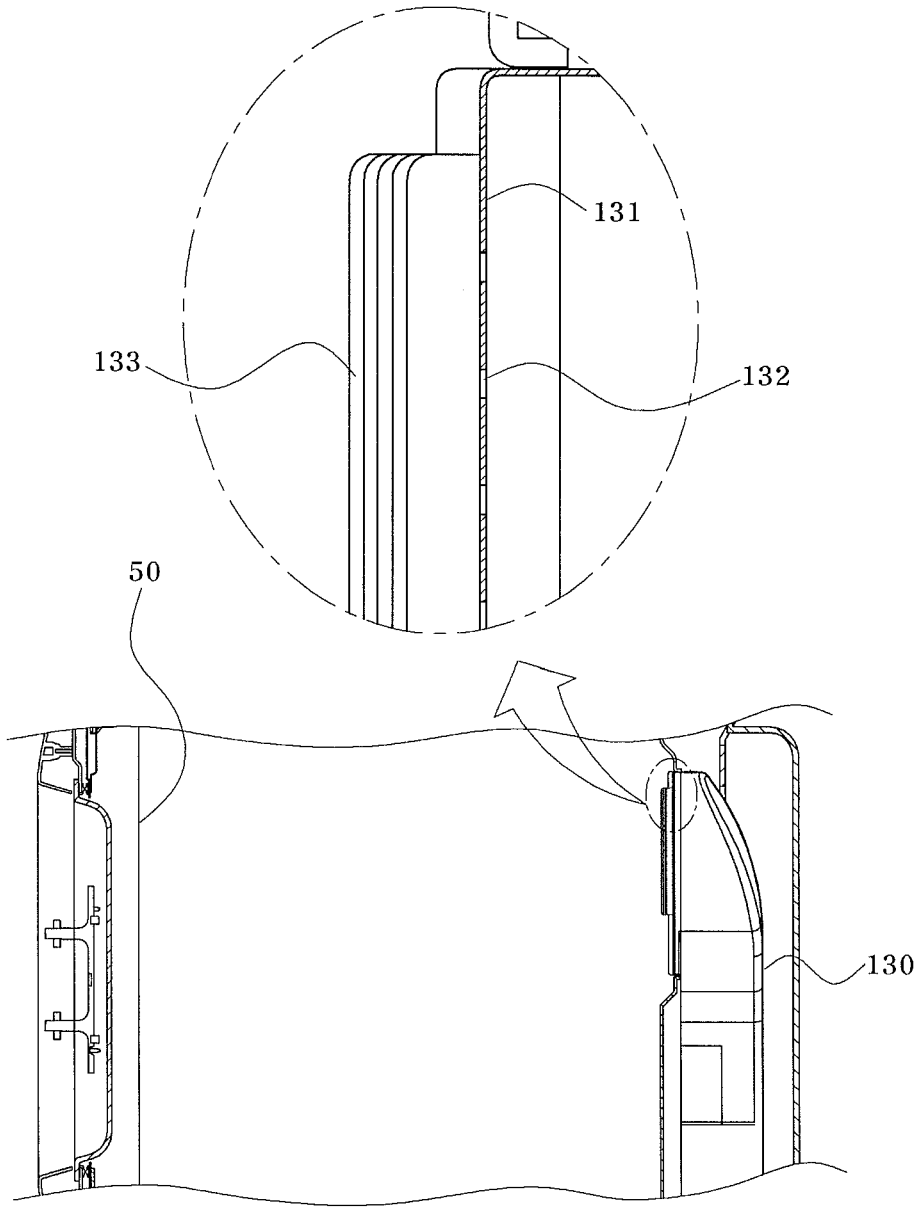
FIG. 6 is a schematic sectional view illustrating that the intake duct in accordance with another embodiment of the present invention is communicated with a drum.

FIG. 5 is a perspective view illustrating an intake duct in accordance with another embodiment of the present invention and FIG. 6 is an assembled sectional view illustrating the intake duct in accordance with another embodiment of the present invention.

Herein, the parts same as or similar to those of in the above described embodiment will not be described again in detail.

Referring to FIGS. 5 and 6, the intake duct 130 is formed with a discharge part 131.

The discharge part 131 is made of a metal material so as to resist to high temperature air for a long time. The discharge part 131 is formed with a plurality of discharge holes 132 for discharging the air therethrough.

The discharge part 131 is formed so that its front side in the rotation direction of the drum 50 is further projected than its rear side in the rotation direction of the drum 50 to form an inclined shape. That is to say, when viewed from the front of the drum 50, the discharge part 131 of FIG. 5 is formed so that its left side is further projected toward the front thereof than its right side to form an inclined shape when the drum 50 rotates in a clockwise direction. On the contrary, the discharge part 131 of FIG. 5 is formed so that its right side is further projected toward the front thereof than its left side to form an inclined shape when the drum 50 rotates in a counterclockwise direction.

Since the discharge part 131 is inclinedly formed with a predetermined angle as described above, it is possible to reduce a contact area between the laundries to be dried and the discharge part 131.

Meanwhile, the discharge part 131 is formed so as not to be projected over the inner surface of the supporting panel (not shown) to which the drum 50 is supported and thus does not obstruct the rotation of the laundries to be dried.

The intake duct 130 is provided with prevention ribs 133. The prevention ribs 133 are further projected toward the front side than the discharge holes 132 to prevent the laundries to be dried from being brought into contact with the discharge holes 132.

The prevention ribs 133 are disposed on the discharge pat 131 in plural with a predetermined spacing and a plurality of the discharge holes 132 is formed between the prevention ribs 133.

The prevention rib 133 is formed with an inclined face 134 at a face thereof opposite to the rotation direction of the drum 50.

The inclined face 134 serves so that during the laundries to be dried are rotated by the rotation of the drum 50, the rotation of the laundries is not obstructed by the prevention ribs 133.

The inclined face may have any sectional shape provided that the shape does not obstruct the rotation of the laundries even though the laundries are brought into contact with the inclined face 134. In the present embodiment, the sectional shape is a straight line.

The prevention rib 133 may be formed integrally with the discharge part 131 or coupled to the discharge part 131 as a separate part.

In the case that the prevention rib 133 is formed integrally with the discharge part 131, there is an advantage that working man hour can be reduced. In the case that the prevention rib 133 is manufactured as a separate part, it is possible to inhibit the damage of the laundries to be dried by manufacturing the prevention rib 133 with a heat resistant plastic material.

Hereinafter, operation of the duct for a dryer in accordance with another embodiment of the present invention will be described.

The laundries to be dried stored in the inside of the drum 50 is lifted up and then dropped by the rotation of the drum 50 and is dried by the heated air supplied to the drum 50.

The discharge part 131 is formed in the intake duct 130, which guides the high temperature air to the inside of the drum 50, to supply the air to the drum 50.

Since the discharge part 131 is inclinedly formed with a predetermined angle according to the rotation direction of the drum 50, it is possible to reduce the contact area between the discharge part 131 and the laundries rotated by the rotation of the drum 50.

Also, since the discharge part 131 is formed with the projected prevention ribs 133, it is possible to inhibit that the laundries to be dried are brought into contact with the discharge part 131 during the rotation of the drum 50 and also prevent that the laundries are brought into contact with the high temperature discharge holes 132.

Although the present invention has been described with reference to the embodiments shown in the drawings, it should be understood that these embodiments are provided for illustrative purpose and that various equivalent modifications and alterations will be apparent to those skilled in the art without departing from the scope and spirit of this invention.

Therefore, the scope and sprit of the invention is limited only by the claims set forth herein as follows.

What is claimed is:

1. A duct for a dryer, comprising an intake duct for supplying air to a drum, wherein the intake duct is provided with a discharge part formed with discharge holes for discharging air therethrough and a plurality of prevention ribs projected from the discharge part toward an interior of the drum, wherein the prevention ribs are formed with an inclined face at a face thereof that faces toward an interior of the drum;

the prevention ribs are disposed apart from each other so as to be non-touching; and the discharge holes are formed between the prevention ribs and faced toward a front end of the drum.

2. The duct for a dryer of claim 1, wherein the discharge part is formed so that one side thereof is further projected than another side thereof to form an inclined shape.

3. The duct for a dryer of claim 1, wherein the prevention ribs are formed integrally with the discharge part.

4. The duct for a dryer of claim 1, wherein the prevention ribs include a heat resistant plastic material.

* * * * *